US007878825B2

(12) United States Patent
Matsumura

(10) Patent No.: US 7,878,825 B2
(45) Date of Patent: Feb. 1, 2011

(54) LEVER-TYPE CONNECTOR

(75) Inventor: Kaoru Matsumura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 36 days.

(21) Appl. No.: 12/490,524

(22) Filed: Jun. 24, 2009

(65) Prior Publication Data

US 2009/0325411 A1 Dec. 31, 2009

(30) Foreign Application Priority Data

Jun. 25, 2008 (JP) ..... P2008-166004

(51) Int. Cl.
*H01R 13/62* (2006.01)

(52) U.S. Cl. ..... 439/157

(58) Field of Classification Search ..... 439/157, 439/160, 152–156, 372, 352, 310, 923; 285/320, 285/208, 311
See application file for complete search history.

(56) References Cited

U.S. PATENT DOCUMENTS 5,401,179 A * 3/1995 Shinchi et al. ..... 439/157
5,474,461 A * 12/1995 Saito et al. ..... 439/157
5,630,727 A * 5/1997 Kameyama ..... 439/352
5,695,349 A * 12/1997 Taguchi et al. ..... 439/157
7,255,580 B2 * 8/2007 Foltz et al. ..... 439/157
2004/0214460 A1 * 10/2004 Osawa et al. ..... 439/157
2006/0089031 A1 * 4/2006 Flowers et al. ..... 439/157
2007/0134957 A1 * 6/2007 Mori et al. ..... 439/157
2007/0197071 A1 * 8/2007 Patterson ..... 439/157

FOREIGN PATENT DOCUMENTS

JP 2008-84725 4/2008

* cited by examiner

*Primary Examiner*—Alexander Gilman
(74) *Attorney, Agent, or Firm*—Finnegan, Henderson, Farabow, Garrett & Dunner, L.L.P.

(57) ABSTRACT

In a lever-type connector, a lever 70 is pivotally mounted on a second connector housing 60, and by operating an operating portion 71 of the lever toward a fitting side, the second connector housing is fitted to a first connector housing 10. By operating the operating portion to a cancellation side opposite to the fitting side, the fitted condition is canceled. A detection member 50 is slidably mounted on the first connector housing. When the lever is pivotally moved to a completely-fitting operating position where the two connector housings are properly fitted together, the detection member can be slid, and the thus slid detection member tells a completely-operated condition of the lever, and also prevents the operating portion of the lever from being operated to be moved toward the cancellation side. When the lever is stopped in a half-fitting operating position before the completely-fitting operating position, the detection member interferes with the operating portion of the lever, and is prevented from sliding movement, and tells an incompletely-operated condition of the lever.

5 Claims, 14 Drawing Sheets

LEVER-TYPE CONNECTOR

FIELD OF THE INVENTION

This invention relates to a lever-type connector in which connector housings can be brought into and out of fitting engagement with each other with a small force, that is, by leverage provided by a lever, and the invention more particularly relates to a lever-type connector having a half-fitting detection function.

DESCRIPTION OF THE RELATED ART

In the field of connectors such as a multi-pole connector in which a high fitting force is required, there has been used a lever-type connector which is provided with a lever for assisting the fitting force. In the lever-type connector, the lever is pivotally mounted on one of a pair of connectors to be fitted together, and the lever, when pivotally moved, assists the two connector housings in fitting connection and disengagement relative to each other through the action of a cam mechanism provided between the lever and the other connector housing.

For example, Patent Literature 1 discloses a lever-type connector having a half-fitting detection function. This conventional lever-type connector includes a first connector housing and a second connector housing which are to be fitted together, and a first fitting detection terminal and a second fitting detection terminal are provided at the first connector housing, and disposed in proximity to each other. A state change member is provided at the first connector housing, and is movable between a contact position where the first and second fitting detection terminals are contacted with each other by the state change member and a non-contact position where the first and second fitting detection terminals are out of contact with each other. An urging member which urges the state changer member into the contact position or the non-contact position is provided at the first connector housing. A lever for bringing the second connector housing into and out of fitting engagement with the first connector housing is provided at the second connector housing. A drive force transmission portion is provided at the lever, and when the fitting of the second connector housing to the first connector housing is completed, the drive force transmission portion moves the state change member into the contact position or the non-contact position against the bias of the urging member.

In this conventional lever-type connector, by electrically detecting a contacted condition of the first and second fitting detection terminals achieved by the operation of the lever, the fitted condition of the two connector housings can be judged.

Patent Literature 1: JP-A-2008-84725

In the above conventional lever-type connector in which the position of the lever is confirmed by an electrical signal, an examination is effected in an energized condition of the connector, and therefore the fitted condition of the connector housings can not be judged before the energized condition is created. Therefore, it is difficult to immediately judge whether or not the fitted condition is proper at the stage at which the two connector housings are connected together. Although the position of the lever can be confirmed, for example, with the eyes, this invites a high risk of mistake, and also lacks in safety. Furthermore, in the above conventional lever-type connector, it is feared that the lever once operated into the fitting position may be accidentally operated to be moved toward the (fitting) cancellation side.

SUMMARY OF THE INVENTION

With the foregoing in view, it is an object of this invention to provide a lever-type connector in which it can be easily judged whether or not a lever has been completely operated, and whether or not a fitted condition of connector housings is proper can be immediately judged at a connecting stage without waiting for an electrical examination, and when the connector housings are properly fitted together, the lever is prevented from being operated to be moved toward a (fitting) cancellation side, thereby enhancing safety.

The invention of a first aspect of the invention is directed to a lever-type connector wherein a lever is pivotally mounted on a second connector housing which is to be fitted to a first connector housing, and by pivotally moving the lever toward a fitting side by operating an operating portion of the lever, the second connector housing can be fitted to the first connector housing, and in the fitted condition of the first and second connector housings, by pivotally moving the lever toward a cancellation side opposite to the fitting side by operating the operating portion, the fitting of the second connector housing relative to the first connector housing can be canceled; characterized in that a detection member is mounted on the first connector housing, and is movable between a first position and a second position, and when the lever is pivotally moved to a completely-fitting operating position where the first and second connector housings are properly fitted together, the detection member can be moved from the first position to the second position, and the detection member thus moved to the second position tells a completely-operated condition of the lever, and also prevents the operating portion of the lever from being operated to be moved toward the cancellation side; and when the lever is stopped in a half-fitting operating position before the completely-fitting operating position, the detection member, moving from the first position toward the second position, interferes with the operating portion of the lever, and therefore can not reach the second position, and tells an incompletely-operated condition of the lever.

A lever-type connector of a second aspect of the invention, depending from the first aspect of the invention, is characterized in that a first retaining portion for retaining the detection member in the first position and a second retaining portion for retaining the detection member in the second position are provided.

A lever-type connector of the invention of a third aspect of the invention, depending from the first aspect of the invention, is characterized in that the detection member is mounted on the first connector housing so as to slide in a direction intersecting a direction of fitting of the second connector housing to the first connector housing, and slide mechanism portions engaged respectively with the first connector housing and the detection member so as to prevent the detection member from being disengaged from the first connector housing and to guide a sliding movement of the detection member are provided.

A lever-type connector of the invention of a fourth aspect of the invention, depending from the first aspect of the invention, is characterized in that a cam surface is formed on the detection member, and when the lever is stopped in a position between the half-fitting operating position and the completely-fitting operating position, and the detection member is moved from the first position toward the second position, the cam surface slides over the operating portion of the lever to pivotally move the lever to the completely-fitting operating position.

A lever-type connector of a fifth aspect of the invention, depending from any one of the first aspect of the invention, is characterized in that the first connector housing includes a first fitting chamber for receiving the second connector housing therein, and a second fitting chamber for receiving a third connector housing therein, the first and second fitting chambers being disposed adjacent to each other, and when the detection member is located in a position before the second position, the detection member prevents the third connector from being fitted into the second fitting chamber.

In the invention of the first aspect of the invention, when the second connector housing is to be fitted to the first connector housing, the lever is pivotally moved to the fitting side, and by doing so, the two connector housings can be fitted together. When this fitted condition is to be canceled, the lever is pivotally moved toward the cancellation side, and by doing so, the fitted condition of the two connector housings can be canceled.

Particularly in this lever-type connector, when the lever is pivotally moved to the completely-fitting operating position where the first and second connector housings are properly fitted together, the detection member can be moved from the first position to the second position. Therefore, it can be judged from this that the two connector housings have been properly fitted together. At this time, the detection member prevents the operating portion of the lever from being operated to be moved to the cancellation side, and therefore it is not feared that the lever may be accidentally moved toward the cancellation side. Thus, the properly-fitted condition can be maintained.

On the other hand, when the lever is not fully or completely operated, so that the two connector housings are disposed in a half-fitted condition, the detection member, moving from the first position toward the second position, interferes with the operating portion of the lever disposed in the half-fitting operating position, and therefore can not reach the second position. Therefore, it can be judged from this that the two connector housings have not been properly fitted together, but are disposed in a half-fitted condition.

Thus, it can be judged only from the position of the detection member whether the lever is in the completely-operated condition or in an incompletely-operated condition, and therefore whether or not the fitted condition of the two connector housings is proper can be immediately judged at the connecting stage without waiting for an electrical examination. And besides, when the two connector housings are properly fitted together, the lever can not be operated to be moved toward the cancellation side, and this enhances safety.

In the invention of the second aspect of the invention, the detection member can be retained in the first position or the second position, and therefore the detection member is prevented from being moved, for example, during transport, and therefore the efficiency of the assembling operation can be enhanced.

In the invention of the third aspect of the invention, whether the lever is disposed in the completely-fitting operating position or the half-fitting operation position, that is, whether the first and second connector housings are disposed in the properly-fitted condition or on a half-fitted condition, can be judged by confirming whether or not the detection member, mounted on the first connector housing through the slide mechanism portions, can be slid from the first position to the second position. In this case, this judgment can be made by the sliding movement of the detection member in the direction intersecting the direction of fitting of the connector housings, and therefore the fitted condition can be easily detected with the eyes. And besides, the detection member mounted on the first connector housing is held against disengagement therefrom by the slide mechanism, and therefore the provisionally-assembled condition can be maintained in a stable manner.

In fourth aspect of the invention, when the lever is pivotally moved beyond the half-fitting operating position (where the lever abuts against the detecting member) toward the fitting side, but is still disposed in a half-operated position, the two connector housings are not properly fitted together. In this condition, when the detection member is moved from the first position toward the second position, the detection member causes the lever to be pivotally moved from the half-operated position to the completely-fitting operating position, thereby properly fitting the two connector housings together. Therefore, the unstably-fitted condition can be prevented.

In fifth aspect of the invention, when the third connector can not be fitted into the first connector housing because of interference of the detection member with this third connector, it is judged that the second connector housing is disposed in a half-fitted condition. Therefore, at least whether or not the second connector housing is properly fitted in the first connector housing can be checked by confirming whether or not the operation for fitting the second connector housing and the third connector housing sequentially into the first connector housing can be carried out smoothly, and this enhances the reliability.

DESCRIPTION OF THE PREFERRED EMBODIMENTS

A preferred embodiment of the present invention will now be described with reference to the drawings.

Figure 1:
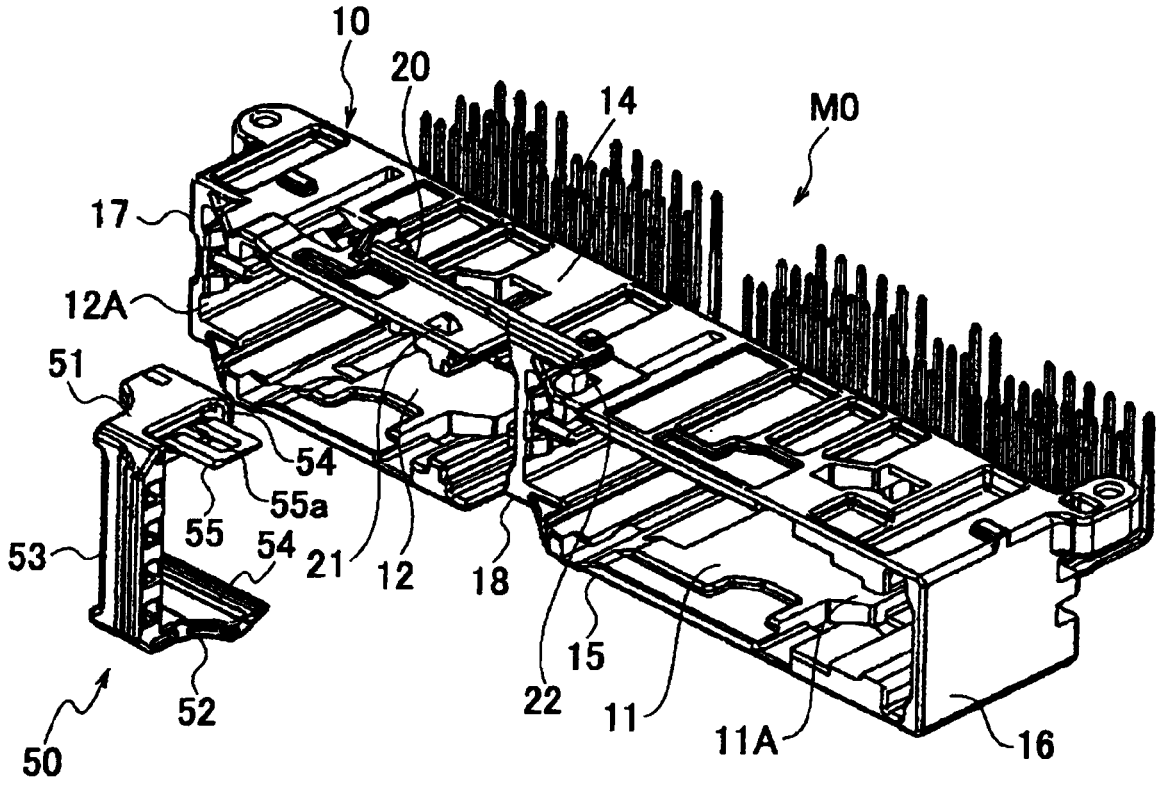
FIG. 1 is an exploded perspective view showing the construction of a first connector used in a preferred embodiment of a lever-type connector of the present invention.
Figure 2:
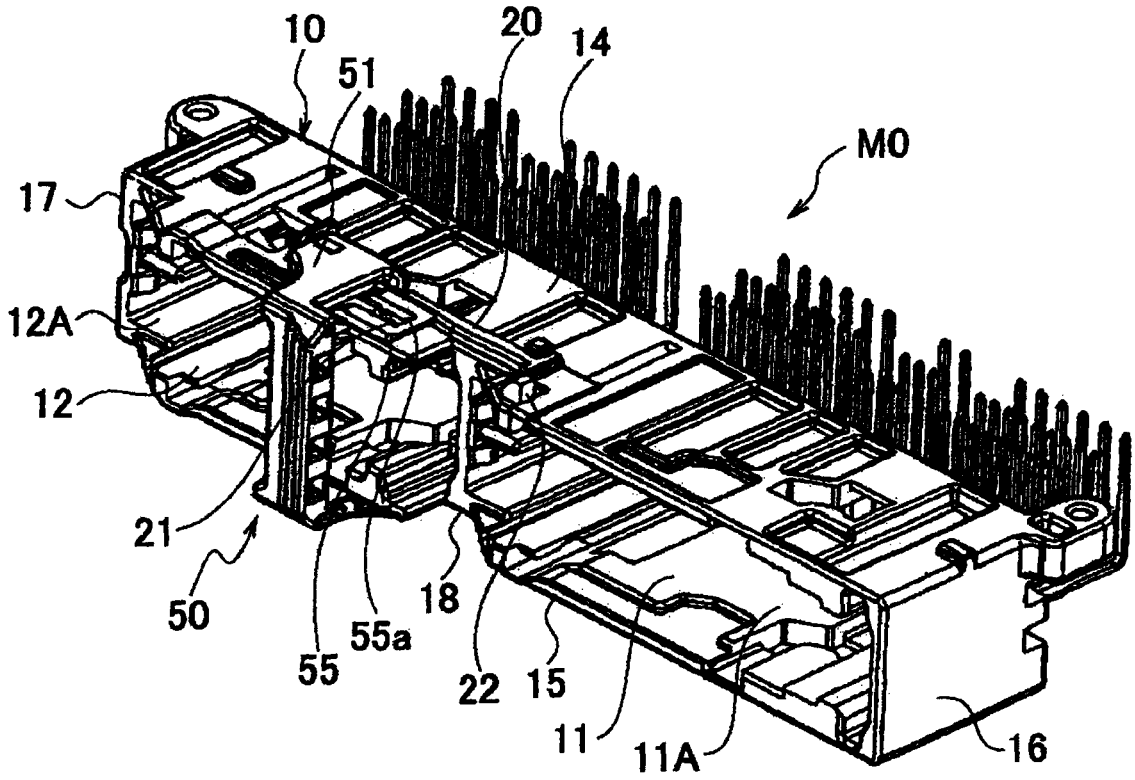
FIG. 2 is a perspective view showing a condition in which a detection member is mounted on the first connector.
Figure 3:
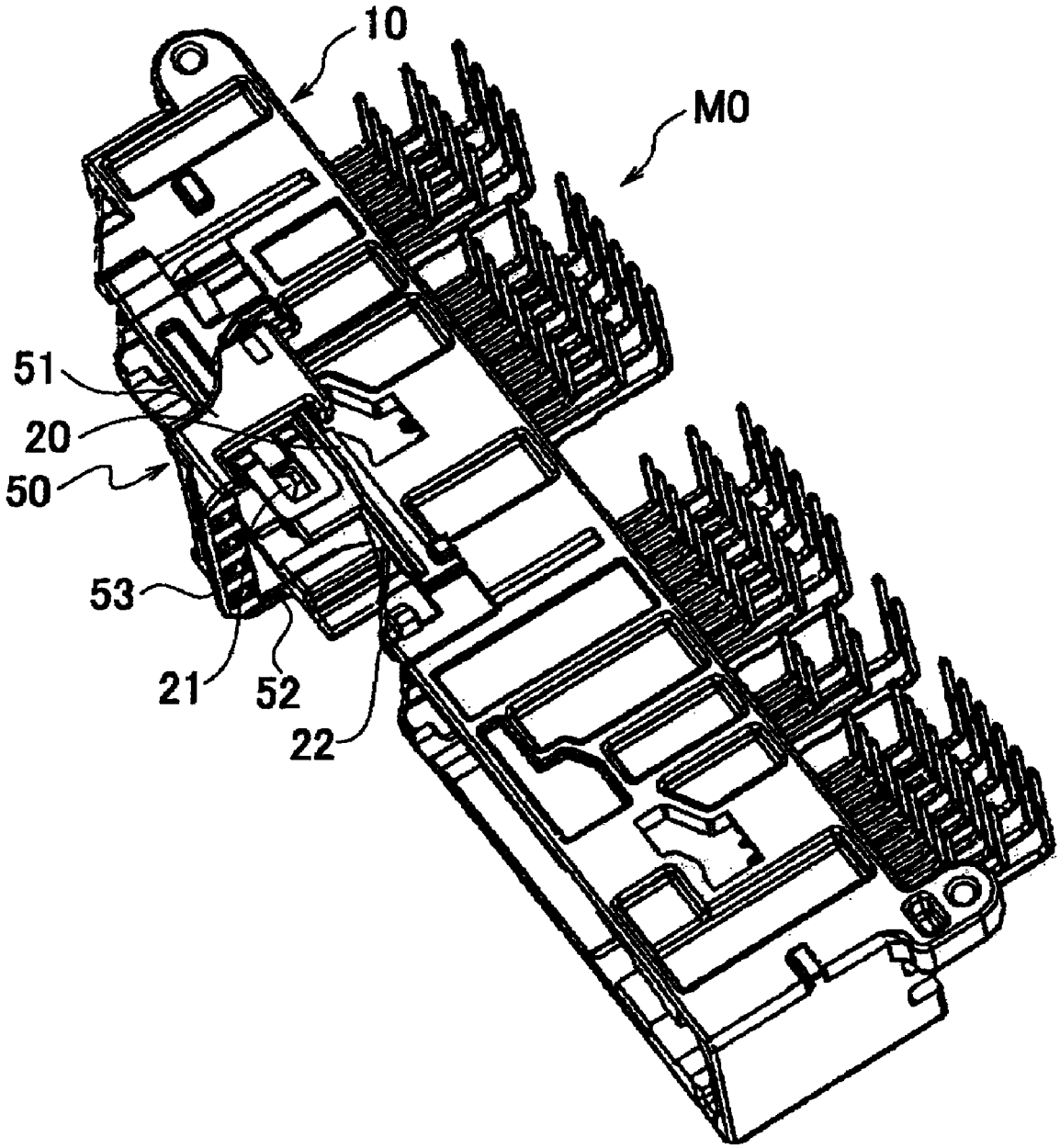
FIG. 3 is a perspective view showing the condition of FIG. 2 as seen from a different angle.
Figure 4:
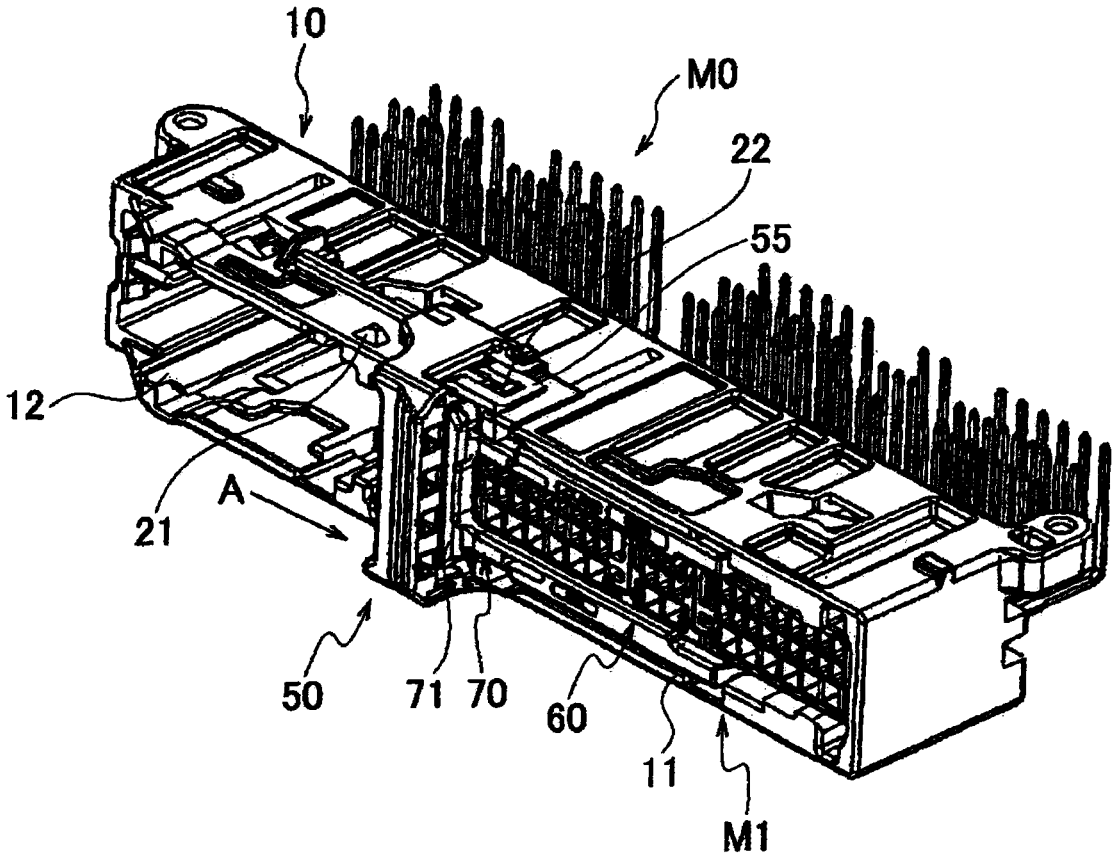
FIG. 4 is a perspective view showing a condition in which after a second connector is properly fitted to the first connector, the detection member is slid into a second position.
Figure 5:
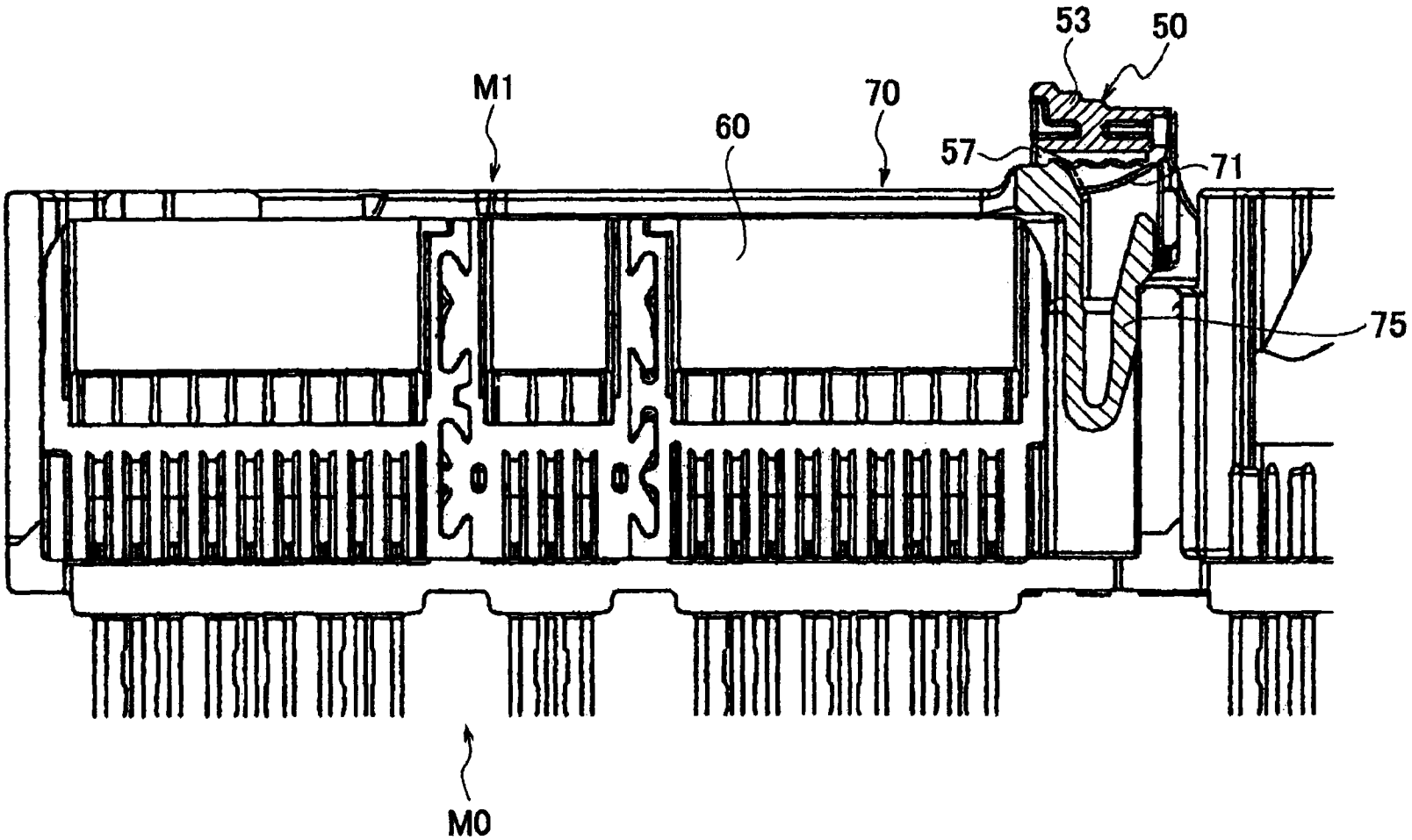
FIG. 5 is a partly cross-sectional view showing the condition of FIG. 4 as seen from the upper side.
Figure 6:
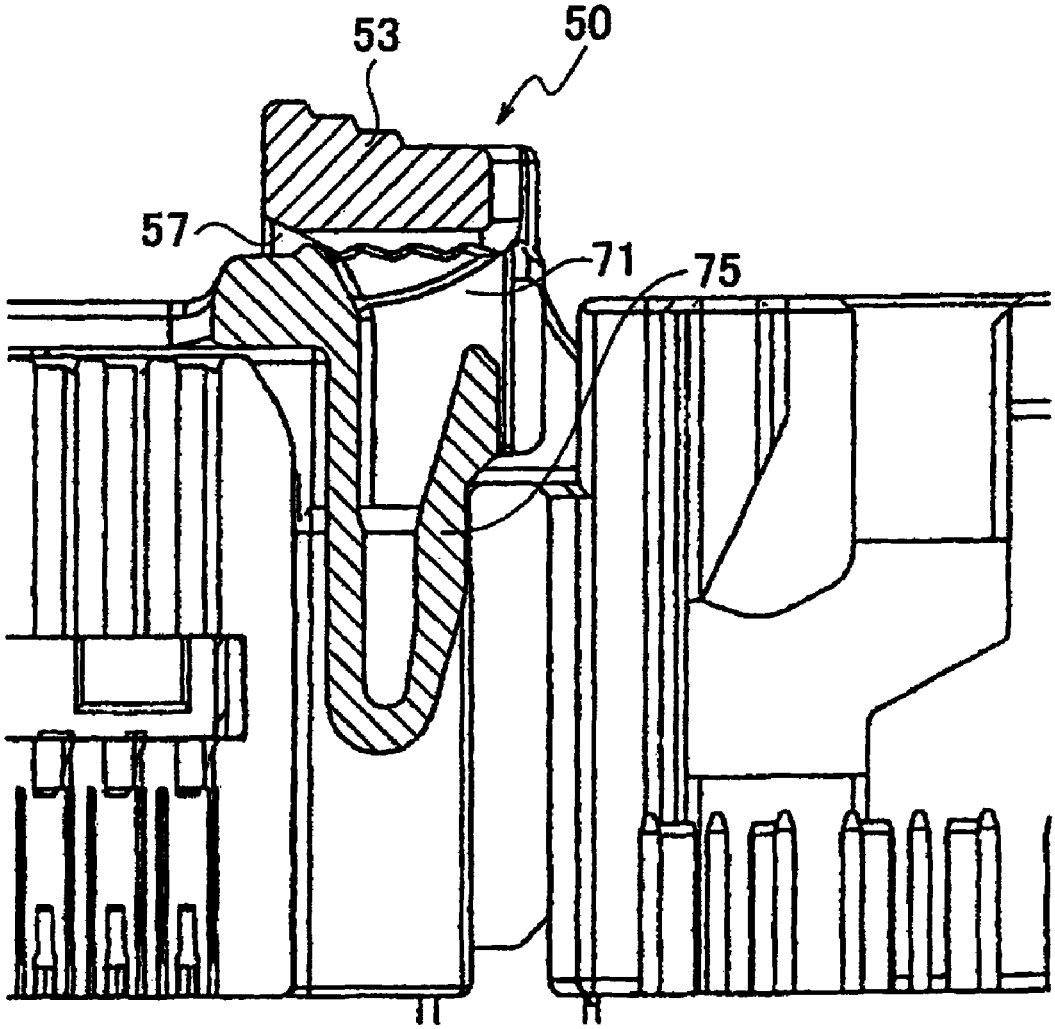
FIG. 6 is an enlarged view of an important portion of FIG. 5.
Figure 7:
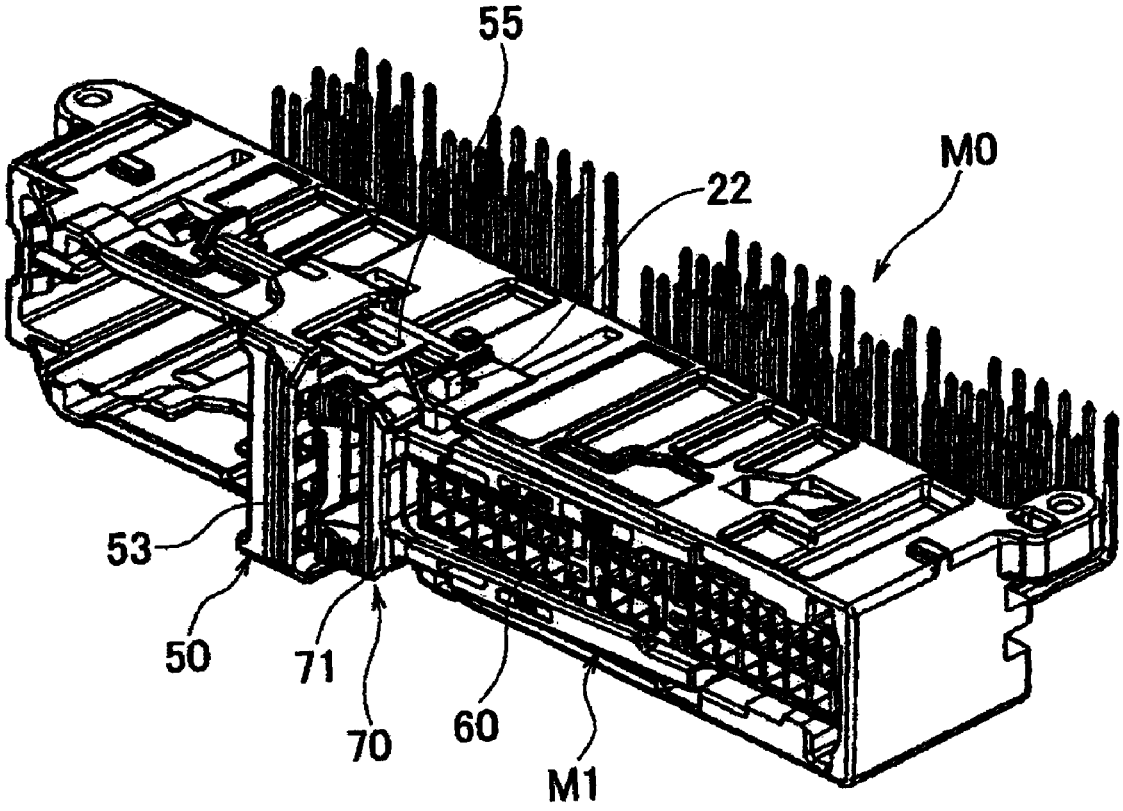
FIG. 7 is a perspective view showing a condition in which the second connector is half fitted to the first connector, so that the detection member can not be slid into the second position.
Figure 8:
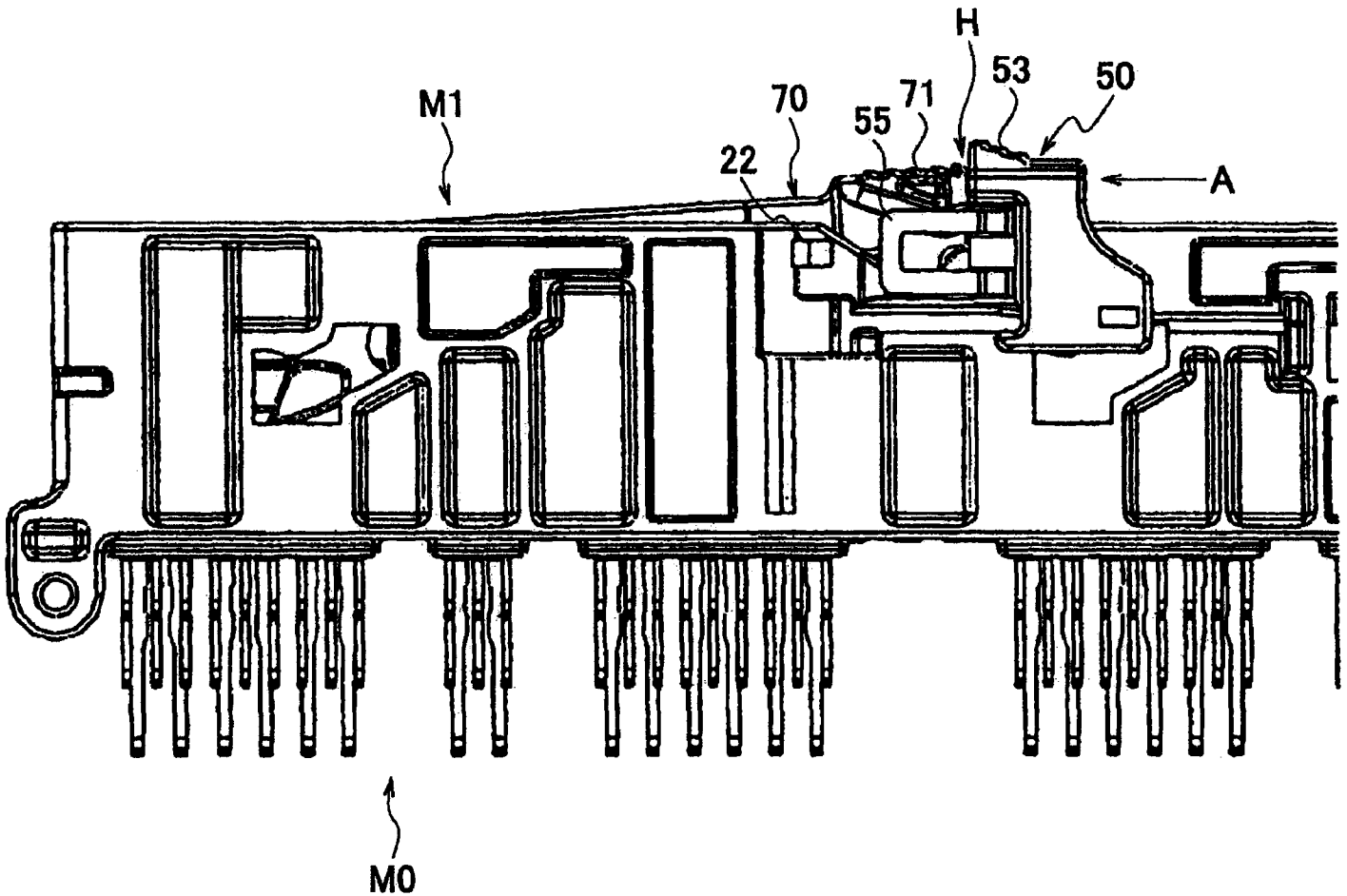
FIG. 8 is a plan view showing an important portion in the condition of FIG. 7 as seen from the upper side.
Figure 9:
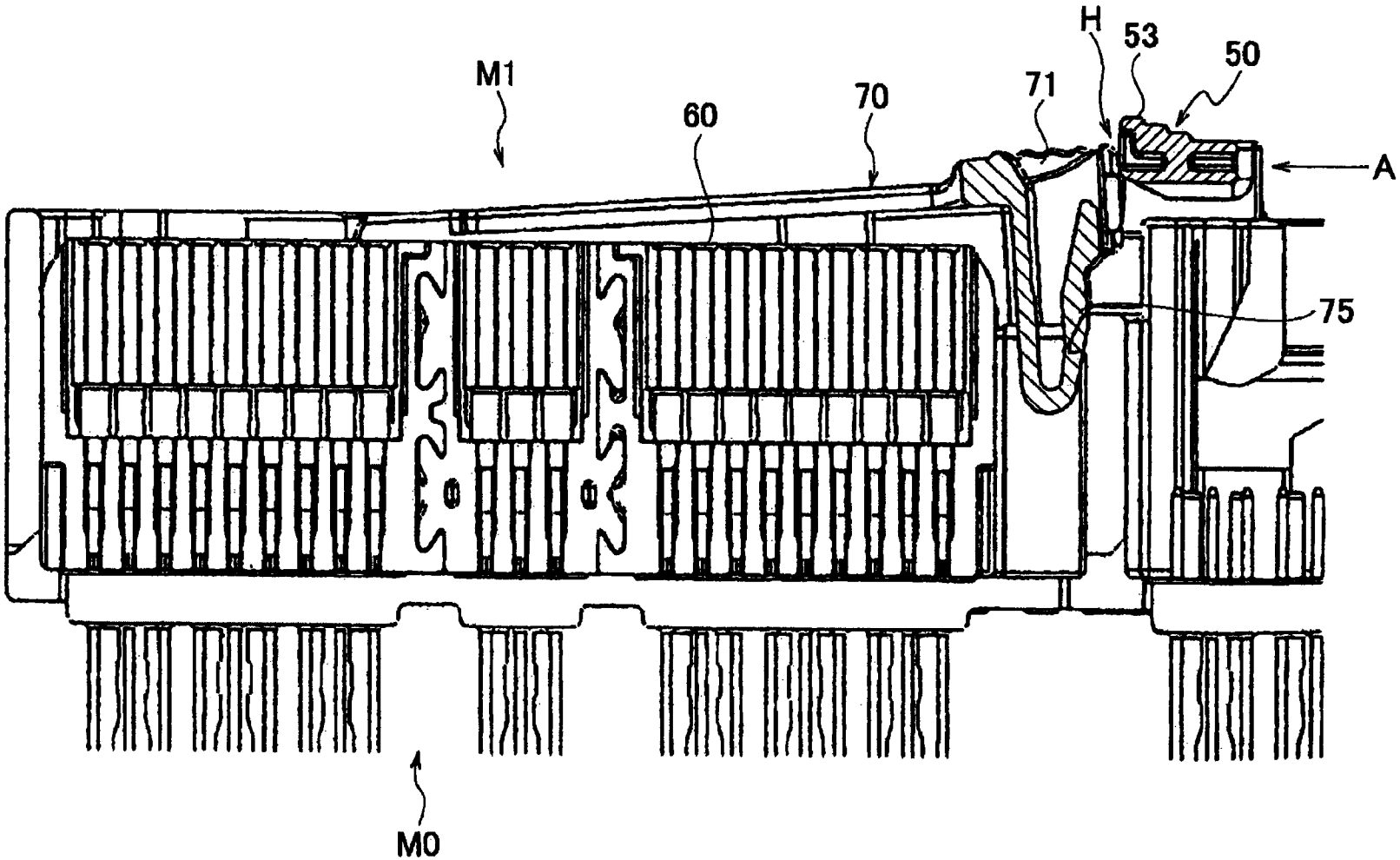
FIG. 9 is a cross-sectional view of an important portion in the condition of FIG. 7 as seen from the upper side.
Figure 10:
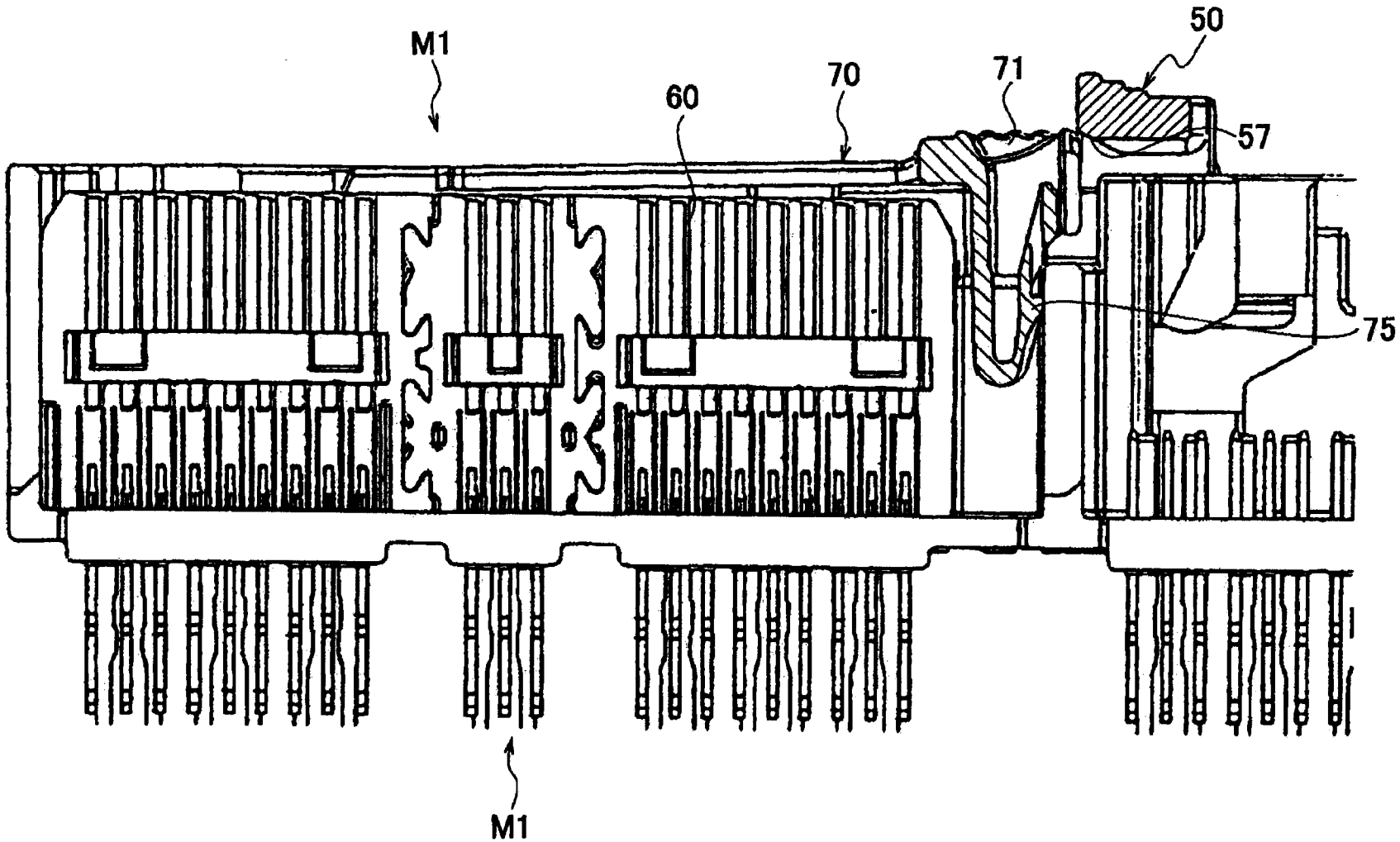
FIG. 10 is a cross-sectional view similar to FIG. 9, but showing a condition in which an operating portion of a lever abuts against a cam surface of the detection member.
Figure 11:
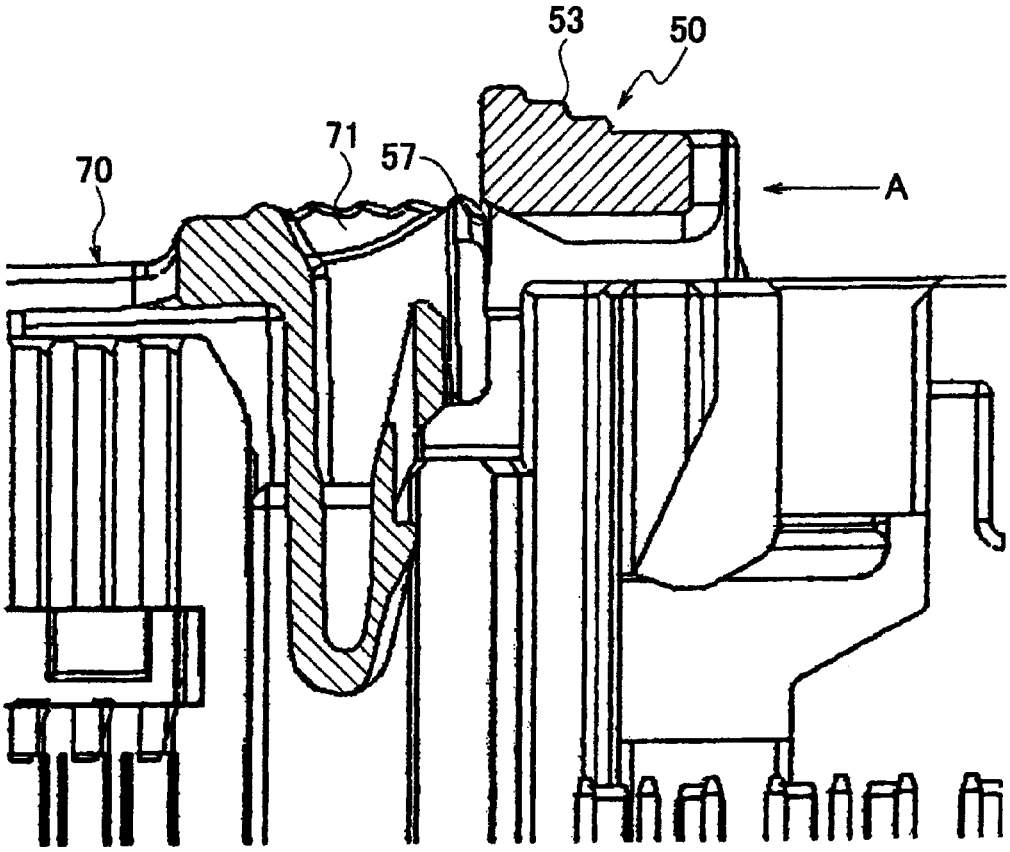
FIG. 11 is an enlarged view of an important portion of FIG. 10.
Figure 12:
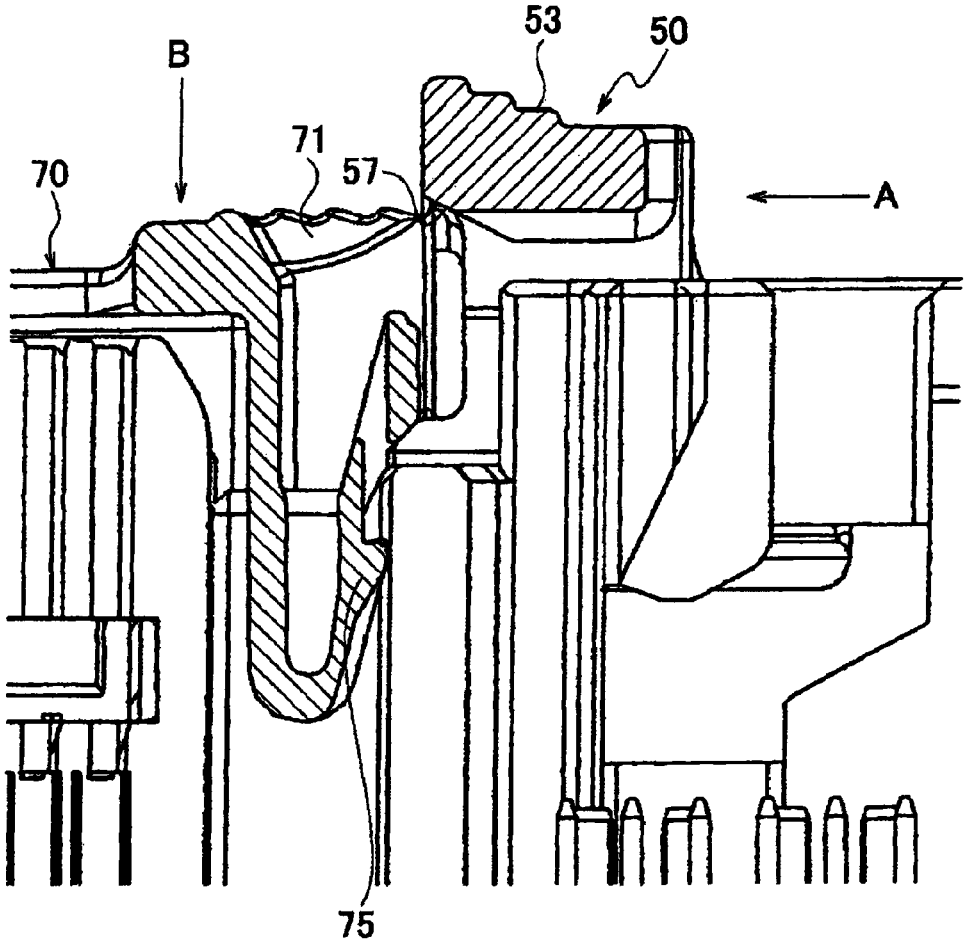
FIG. 12 is an enlarged view similar to FIG. 11, but showing a condition in which the detection member is further moved in a direction of arrow A from the condition of FIG. 11.
Figure 13:
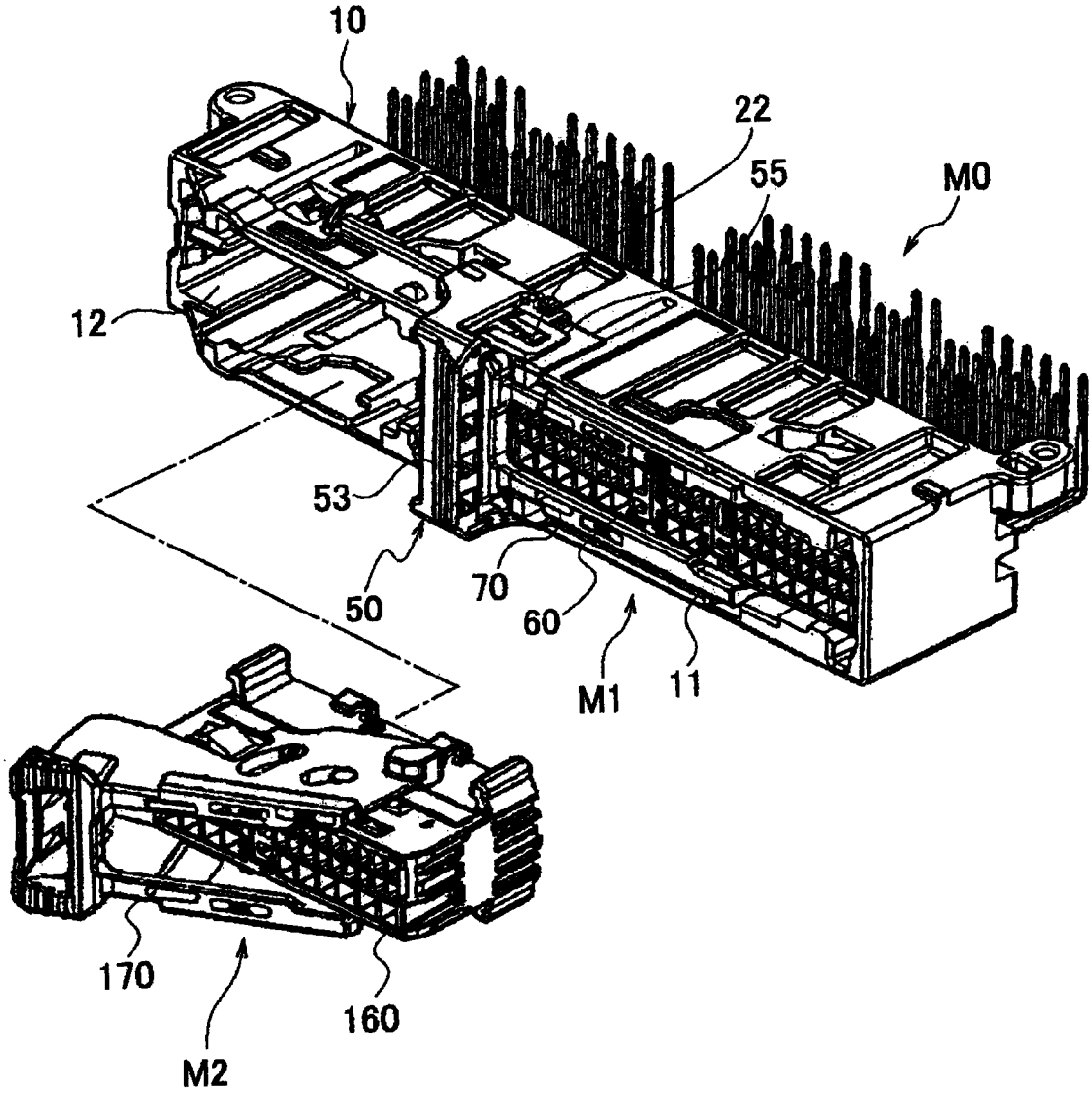
FIG. 13 is a perspective view showing a condition in which the second connector is properly fitted to the first connector, and the detection member is slid to the second position, and then a third connector is to be fitted to the first connector.

FIG. 1 is an exploded perspective view showing the construction of a first connector, FIG. 2 is a perspective view showing a condition in which a detection member is mounted on the first connector, FIG. 3 is a perspective view showing the condition of FIG. 2 as seen from a different angle, FIG. 4 is a perspective view showing a condition in which after a second connector is properly fitted to the first connector, the detection member is slid into a second position, FIG. 5 is a partly cross-sectional view showing the condition of FIG. 4 as seen from the upper side, FIG. 6 is an enlarged view of an important portion of FIG. 5, FIG. 7 is a perspective view showing a condition in which the second connector is half fitted to the first connector, so that the detection member can not be slid to the second position, FIG. 8 is a plan view showing an important portion in the condition of FIG. 7 as seen from the upper side, FIG. 9 is a cross-sectional view of an important portion in the condition of FIG. 7 as seen from the upper side, FIG. 10 is a cross-sectional view similar to FIG. 9, but showing a condition in which an operating portion of a lever abuts against a cam surface of the detection member, FIG. 11 is an enlarged view of an important portion of FIG. 10 showing this abutting condition, and FIG. 12 is an enlarged view similar to FIG. 11, but showing a condition in which the detection member is further moved from the condition of FIG. 11. FIG. 13 is a perspective view showing a condition in which the second connector is properly fitted to the first connector, and the detection member is slid to the second position, and then a third connector is to be fitted to the first connector, and FIG. 14 is a perspective view showing a condition in which the second connector is half fitted to the first connector, and therefore the detection member can not be slid to the second position, and therefore even when trying to fit the third connector to the first connector, this can not be achieved because of interference of the detection member with the third connector.

Figure 14:
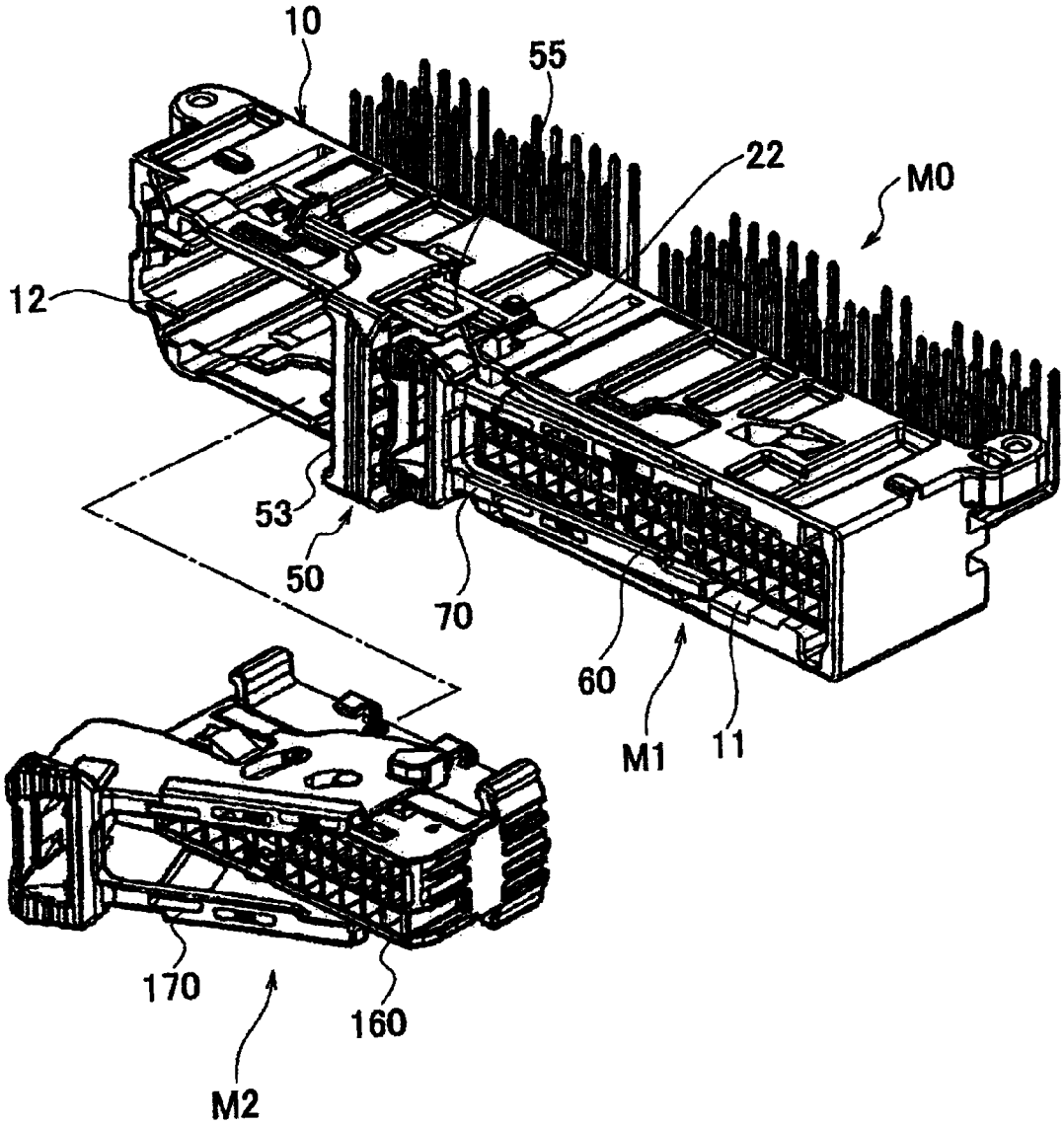
FIG. 14 is a perspective view showing a condition in which the second connector is half fitted to the first connector, and therefore the detection member can not be slid to the second position, and therefore even when trying to fit the third connector to the first connector, this can not be achieved because of interference of the detection member with the third connector.

As shown in FIGS. 13 and 14 generally showing its overall construction, this lever-type connector comprises the first connector (female connector) M0, the second connector (male connector) M1, and the third connector (male connector) M2.

The first connector M0 (which is the female connector) includes a first connector housing (female housing) 10 having a required number of terminals mounted thereon, and the detection member 5 mounted on the front side of the first connector housing 10. The second connector M1 (which is the male connector) includes a second connector housing (male housing) 60 having a required number of terminals (not shown) mounted therein, and the lever 70 mounted on the second connector housing 60. The third connector M2 (which is the male connector) includes a third connector housing (male housing) 160 having a required number of terminals (not shown) mounted therein, and a lever 170 mounted on the third connector housing 160.

As shown in FIGS. 1 to 3, a first fitting chamber 11 for receiving the connector housing 60 of the second connector M1 therein and a second fitting chamber 12 for receiving the connector housing 160 of the third connector M2 therein are formed in the front side of the first connector housing 10, and are disposed adjacent to each other. The first and second fitting chambers 11 and 12 are defined by a top plate 14, a bottom plate 15, opposite (right and left) side plates 16 and 17 and an intermediate partition plate 18 which jointly form the first connector housing 10. The front side (or face) of the first fitting chamber 11 is open to define a fitting face 11A, while the front side (or face) of the second fitting chamber 12 is open to define a fitting face 12A.

Slide rails 20 (serving as a slide mechanism) are formed respectively on an upper surface (outer surface) of the top plate 14 and a lower surface (outer surface) of the bottom plate 15, and extend in a direction parallel to the fitting faces 11A and 12A (that is, in a direction perpendicular to a direction (hereinafter referred to as "connector fitting direction") of fitting of each of the second and third connectors M1 and M2 into the first connector M0).

The detection member 50 has a generally U-shaped cross-section, and includes a pair of parallel plates 51 and 52 for contact respectively with the outer surfaces of the top and bottom plates 14 and 15 of the first connector housing 10 (which are opposed to each other with the fitting chambers 11 and 12 lying therebetween), and an interconnecting plate 53 interconnecting the pair of parallel plates 51 and 52. Each of the upper and lower parallel plates 51 and 52 has a guide groove 54 (serving as the slide mechanism) formed in its inner surface. By engaging the two guide grooves 54 respectively with the slide rails 20 formed respectively on the outer surfaces of the top and bottom plates 14 and 15 of the first connector housing 10, the detection member 50 is mounted on the first connector housing 10 so as to slide in a direction perpendicular to the connector fitting direction. And besides, since the guide grooves 54 are engaged respectively with the slide rails 20, the detection member 50 is so held on the first connector housing 10 as not to be easily disengaged from the first connector housing 10 forwardly (that is, in a direction away from the rear side of the first connector housing 10).

On the other hand, the lever 70 of the second connector M1 is pivotally mounted at one end thereof on the second connector housing 60, and has the operating portion 71 formed at the other end thereof. By operating (or manipulating) the operating portion 71 of the lever 70, the lever 70 is pivotally moved toward the fitting side (that is, toward the first connector housing 10), and by doing so, the second connector housing 60 can be fitted into the first connector housing 10. In this fitted condition, when the operating portion 71 of the lever 70 is operated to pivotally move the lever 70 toward a cancellation side opposite to the fitting side (that is, in a direction of withdrawing of the second connector M1 forwardly from the first connector M0), the fitting of the second connector housing 60 relative to the first connector housing 10 can be canceled.

In order to provide this function, a cam mechanism (which is not shown, and comprises a cam pin and a cam groove), etc., are provided at the lever 70 and the first connector housing 10. A lock arm 75 is formed on the operating portion 71, and when the lever 70 is pivotally moved to a position (hereinafter referred to as "completely-fitting operating position") where the first connector housing 10 and the second connector housing 60 are completely fitted together, the lock arm 75 is engaged with a lock portion (not shown) provided at the first connector housing 10.

The lever 170 of the third connector M2 is similar in construction to the lever 70, and therefore explanation thereof will be omitted here.

The detection member 50 mounted on the first connector housing 10 can be slid between a first position (shown in FIGS. 2 and 3) and the second position (shown in FIG. 4). A first retaining projection (first retaining portion) 21 for engagement in a hole 55*a* in a retaining frame 55 of the detection member 55 to locate the detection member 50 in the first position is formed on the first connector housing 10, and also a second retaining projection (second retaining portion) for engagement in the hole 55*a* of the retaining frame 55 to locate the detection member 50 in the second position is formed on the first connector housing 10.

When the lever 70 of the second connector M1 is pivotally moved into the completely-fitting operating position to achieve the properly-fitted condition of the first and second connector housings 10 and 60 as shown in FIGS. 4 to 6, the operating portion 71 of the lever 70 will not interfere with the interconnecting plate 53 of the detection member 50, and therefore the detection member 50 can be moved from the first position (shown in FIGS. 2 and 3) to the second position. When the detection member 50 is thus moved to the second position, this detection member 50 tells the operator that the lever 70 has been completely (or fully) operated, and also the interconnecting plate 53 covers the operating portion 71 and the lock arm 75 of the lever 70, thereby preventing the operating portion 71 from being operated to be moved toward the (fitting) cancellation side.

When the lever 70 is stopped at a half-fitting operating position before the completely-fitting operating position as shown in FIGS. 7 to 9, the interconnecting plate 53 interferes with the operating portion 71 of the lever 70 disposed in a projecting condition, and therefore the detection member 50 is prevented from moving in a direction of arrow A from the first position to the second position, and serves to tell the operator that the lever 70 is disposed in an incompletely-operated condition.

The chamfer-like cam surface 57 is formed at an inner corner portion of that side of the interconnecting plate 53 (of the detection member 50) which is directed toward the second position when the detection member 50 is slid from the first position toward the second position, as shown in FIGS. 10 to 12. When the operating portion 71 of the lever 70 is stopped between the half-fitting operating position and the completely-fitting operating position as shown in FIGS. 10 to 12, and the detection member 50 moves in the direction of arrow A from the first position to the second position, the cam surface 57 slides over the operating portion 71 of the lever 70 to press the lever 70, and pivotally moves this lever 70 into the completely-fitting operating position.

The positional relation between the detection member 50 and the second fitting chamber 12 is so predetermined that the third connector M2 can or can not be fitted into the second fitting chamber 12, depending on the position of the detection member 50. Namely, the positional relation between the detection member 50 and the second fitting chamber 12 is so predetermined that when the detection member 50 is located in a position before the second position, the detection member 50 prevents the third connector housing 160 of the third connector M2 from fitting into the second fitting chamber 12.

Next, the operation will be described.

First, as shown in FIGS. 1 to 3, the detection member 50 is mounted on the first connector housing 10, with the guide grooves 54 engaged respectively with the slide rails 20, and the retaining frame 55 is engaged with the first retaining projection 21. Then, the second connector M1 is initially fitted into the first fitting chamber 11 of the first connector M0, and in this condition the lever 70 is pivotally moved toward the fitting side, thereby completely fitting the second connector housing 60 into the first fitting chamber 11 of the first connector housing 10. For canceling this fitted condition, the lever 70 is pivotally moved toward the fitting cancellation side, thereby canceling the mutually-fitted condition of the two connector housings 10 and 60.

In the lever-type connector of this embodiment, it is necessary to slide the detection member 50 from the first position to the second position after the second connector housing 60 is thus fitted into the first connector housing 10.

When the lever 70 has been pivotally moved to the completely-fitting operating position where the two connector housings 10 and 60 are properly (completely) fitted together, the detection member 50 can be moved from the first position to the second position as shown in FIGS. 4 to 6. Therefore, when the detection member 50 can thus be moved from the first position to the second position, it can be judged from this that the two connector housings 10 and 60 have been properly fitted together. At this time, the detection member 50 covers the operating portion 71 and the lock arm 75 of the lever 70 to prevent the operation portion 71 from being operated to be moved toward the fitting cancellation side. Therefore, it is not feared that the lever 70 may be accidentally moved toward the fitting cancellation side, and therefore the properly-fitted condition of the two connector housings is maintained.

On the other hand, when the lever 70 is not completely (or fully) pivotally moved to the completely-fitting operating position, so that the two connector housings 10 and 60 are in a half-fitted condition as shown in FIGS. 7 to 9, the interconnecting plate 53 of the detection member 50 moving from the first position toward the second position interferes with the operating portion 71 of the lever 70 disposed in this half-fitting operating position, and therefore the detection member 50 can not be moved in the direction of arrow A to the second position. Therefore, it can be judged from this that the two connector housings 10 and 60 have not been properly fitted together, but are disposed in the half-fitted condition.

Thus, it can be judged only from the position of the detection member 50 whether the lever 70 is in the completely-operated condition or in the incompletely-operated condition, and therefore whether the fitted condition of the first and second connectors M0 and M1 is proper or not can be immediately judged at the connecting stage without waiting for an electrical examination. And besides, when the first and second connectors M0 and M1 are properly fitted together, the lever 70 can not be operated toward the fitting cancellation side, and this enhances safety.

When the third connector M2 can be fitted into the first connector M0 without interference of the detection member 50, this means that the detection member 50 has been properly slid to the second position. Therefore, it can be judged also from this that the first and second connectors M0 and M1 are disposed in the properly-fitted condition.

On the other hand, when the third connector M2 can not be fitted into the first connector M0 because of interference of the detection member 50 with this third connector M2, this means that the detection member 50 has failed to be slid to the second position. Therefore, it can be judged from this that the first and second connectors M0 and M1 are disposed in the half-fitted condition.

Therefore, at least whether or not the second connector M1 is properly fitted in the first connector M0 can be checked by confirming whether or not the operation for fitting the second connector M1 and the third connector M2 sequentially into the first connector M0 can be carried out smoothly, and this enhances the reliability.

When the lever 70 is pivotally moved beyond the half-fitting operating position (where the lever 50 abuts against the detecting member 50) toward the fitting side, but is still disposed in a half-operated position, the first and second connector housings 10 and 60 are not properly fitted together as shown in FIGS. 10 to 12. In this condition, when the detection member 50 is moved in the direction of arrow A from the first position toward the second position, the cam surface 57 is brought into contact with the operating portion 71 of the lever 70 to pivotally move the lever 70 from the half-operated position to the completely-fitting operating position. As a result, the first and second connector housings 10 and 60 are properly fitted together. Therefore, the unstably-fitted condition can be prevented.

In the lever-type connector of this embodiment, the first and second retaining projections 21 and 22 are formed on the first connector housing 10, and the detection member 50 can be retained in the first position by the first retaining projection 21, and can also be retained in the second position by the second retaining projection 22. Therefore, the detection member 50 is prevented from being moved, for example, during transport, and therefore the efficiency of the assembling operation can be enhanced.

In the lever-type connector of this embodiment, the sliding movement of the detection member 50 is guided by the slide rails 20 and the guide grooves 54, and whether the lever 70 is disposed in the completely-fitting operating position or the half-fitting operation position, that is, whether the first and second connectors M0 and M1 are properly fitted together, can be judged by confirming whether or not the detection member can be slid from the first position to the second position. Thus, the fitted condition of the first and second connectors can be easily detected with the eyes. Furthermore, the detection member 50 can be held on the first connector housing 10 against disengagement therefrom by the guide grooves 54 engaged with the respective slide rails 20, and therefore the provisionally-assembled condition can be maintained in a stable manner.

In the above embodiment, although the second retaining projection (second retaining portion) 22 for retaining the detection member 50 in the second position is formed on the first connector housing 10, the second retaining projection may be formed on the lever 70.

What is claimed is:

1. A lever-type connector, comprising:

a first connector housing;

a second connector housing to be fitted to the first connector housing; and a lever pivotally mounted on the second connector housing;

wherein the second connector housing is to be fitted to the first connector housing by pivotally moving the lever toward a fitting side by operating an operating portion of the lever; and the fitting of the second connector housing relative to the first connector housing is to be canceled from a fitted condition of the first and second connector housings, by pivotally moving the lever toward a cancellation side opposite to the fitting side by operating the operating portion;

a detection member is mounted on the first connector housing and is movable between a first position and a second position;

when the lever is pivotally moved to a completely-fitting operating position where the first and second connector housings are properly fitted together, the detection member is movable from the first position to the second position, and the detection member moved to the second position tells a completely-operated condition of the lever and prevents the operating portion of the lever from being operated to be moved toward the cancellation side; and when the lever is stopped in a half-fitting operating position before the completely-fitting operating position, the detection member moving from the first position toward the second position interferes with the operating portion of the lever so as not to reach the second position, and tells an incompletely-operated condition of the lever.

2. The lever-type connector according to claim 1, wherein a first retaining portion for retaining the detection member in the first position and a second retaining portion for retaining the detection member in the second position are provided.

3. The lever-type connector according to claim 1, wherein the detection member is mounted on the first connector housing so as to slide in a direction intersecting a direction of fitting of the second connector housing to the first connector housing; and slide mechanism portions engaged respectively with the first connector housing and the detection member so as to prevent the detection member from being disengaged from the first connector housing and to guide a sliding movement of the detection member are provided.

4. The lever-type connector according to claim 1, wherein a cam surface is formed on the detection member, and when the lever is stopped in a position between the half-fitting operating position and the completely-fitting operating position, and the detection member is moved from the first position toward the second position, the cam surface slides over the operating portion of the lever to pivotally move the lever to the completely-fitting operating position.

5. The lever-type connector according to claim 1, wherein the first connector housing includes a first fitting chamber for receiving the second connector housing therein, and a second fitting chamber for receiving a third connector housing therein, the first and second fitting chambers being disposed adjacent to each other, and when the detection member is located in a position before the second position, the detection member prevents the third connector from being fitted into the second fitting chamber.

* * * * *